US005549222A

United States Patent [19]

Schroeder

[11] Patent Number: 5,549,222

[45] Date of Patent: Aug. 27, 1996

[54] BEVERAGE DISPENSING NOZZLE

[75] Inventor: Alfred A. Schroeder, San Antonio, Tex.

[73] Assignee: Lancer Corporation

[21] Appl. No.: 257,749

[22] Filed: Jun. 9, 1994

[51] Int. Cl.[6] ..... B67D 5/56

[52] U.S. Cl. ..... 222/129.1; 222/145.6; 222/459; 239/432

[58] Field of Search ..... 222/129.1, 129.2, 222/129.3, 129.4, 145, 459, 564; 239/432

[56] References Cited

U.S. PATENT DOCUMENTS

| | | | |
|---|---|---|---|
| 3,795,364 | 3/1974 | Kattner | 239/432 X |
| 4,370,062 | 1/1983 | Moody | 239/432 X |
| 4,907,725 | 3/1990 | Durham | 222/459 X |
| 5,048,726 | 9/1991 | McCann et al. | 222/129.1 |
| 5,060,824 | 10/1991 | Credle, Jr. | 222/129.2 X |
| 5,203,474 | 4/1993 | Haynes | 222/129.1 |

*Primary Examiner*—Andres Kashnikow

*Assistant Examiner*—Joseph A. Kaufman

*Attorney, Agent, or Firm*—Donald R. Comuzzi; Christopher L. Makay

[57] ABSTRACT

A post mix beverage dispensing nozzle includes a housing that contains a diffuser. The nozzle connects to a dispensing valve for dispensing a viscous beverage syrup that must be mixed with a mixing fluid, such as water, before dispensing. The diffuser comprises a plurality of interconnected plates with the top plate contacting the beverage syrup entering the nozzle to direct the beverage syrup radially outward in a thin sheet. As the beverage syrup expands radially outward past the surface of the top plate, the mixing fluid shears the beverage syrup and forces it to cascade down the remaining plates of the diffuser. The top plate of the diffuser forces the beverage syrup into a thin sheet to expose a maximum surface area of the beverage syrup to the water, while the cascading effect created by the remaining plates results in vigorous mixing that produces a dispensed beverage having the desired mix ratio between mixing fluid and beverage syrup.

4 Claims, 2 Drawing Sheets

BEVERAGE DISPENSING NOZZLE

BACKGROUND OF THE INVENTION

1. Field of the Invention

The present invention relates to beverage dispensing equipment and, more particularly, but not by way of limitation, to a postmix beverage dispensing nozzle for mixing viscous beverage syrups with a mixing fluid such as water before dispensing. For the purposes of disclosure and to aid in the understanding of the postmix beverage dispensing nozzle, it will be described in an environment suitable for the dispensing of tea made from a viscous tea syrup mixed with water. However, the postmix beverage dispensing nozzle may be utilized to dispense any beverage such as orange juice created from a highly viscous syrup or frozen concentrate.

2. Description of the Related Art

Due to the immense popularity of iced tea, a majority of food and drink service establishments serve it in either a sweetened or unsweetened form. It is generally produced by mixing a powdered tea concentrate with water in a gravity flow dispenser. The hand making of the tea is both time consuming as well as less than completely sanitary. Accordingly, food and drink service establishments desire beverage dispensing equipment which is capable of dispensing tea produced from a tea syrup mixed with water at a postmix dispensing valve.

Tea syrup is extremely viscous, particularly when mixed with sugar for sweetened tea. Consequently, standard postmix dispensing valves are incapable of thoroughly mixing the viscous tea syrup with water to produce a tea drink having the proper mix ratio.

Thus, the postmix beverage dispensing nozzle of the present invention has been designed to vigorously mix viscous syrups with a mixing fluid, typically water, to form a dispensed beverage having the proper mix ratio.

SUMMARY OF THE INVENTION

In accordance with the present invention, a post mix beverage dispensing nozzle connects to a standard dispensing valve. The nozzle includes a housing which contains a diffuser. The diffuser comprises a plurality of plates interconnected by a post. The dispensing valve directs a viscous beverage syrup onto the top plate of the diffuser. As the beverage syrup contacts the top plate it spreads out into a thin sheet which mixes with a mixing fluid, typically water, delivered about the top plate from the dispensing valve. Vigorous mixing between the mixing fluid and beverage syrup occurs because, by forming the beverage syrup into a thin sheet, a maximum surface area of the beverage syrup is exposed for mixing with the mixing fluid. The mixing fluid shears the thin sheet of beverage syrup as it passes from the top plate and forces the beverage syrup onto the remaining plates of the diffuser. As the mixing fluid and beverage syrup cascade among the plates of the diffuser, they vigorously mix to form a dispensed beverage which has a desired mix ratio of mixing fluid to beverage syrup.

It is, therefore, an object of the present invention to provide a postmix beverage dispensing nozzle that vigorously mixes a viscous beverage syrup with a mixing fluid.

It is another object of the present invention to provide a post mix beverage dispensing nozzle which maximizes the surface area of the beverage syrup exposed to the mixing fluid.

It is a further object of the present invention to provide a post mix beverage dispensing nozzle with a diffuser having a plurality of plates that produce a step mixing effect resulting in the total mixing of the beverage syrup and mixing fluid.

Still other objects, features, and advantages of the present invention will become evident to those skilled in the art in light of the following.

DETAILED DESCRIPTION OF THE PREFERRED EMBODIMENT

Figure 1:
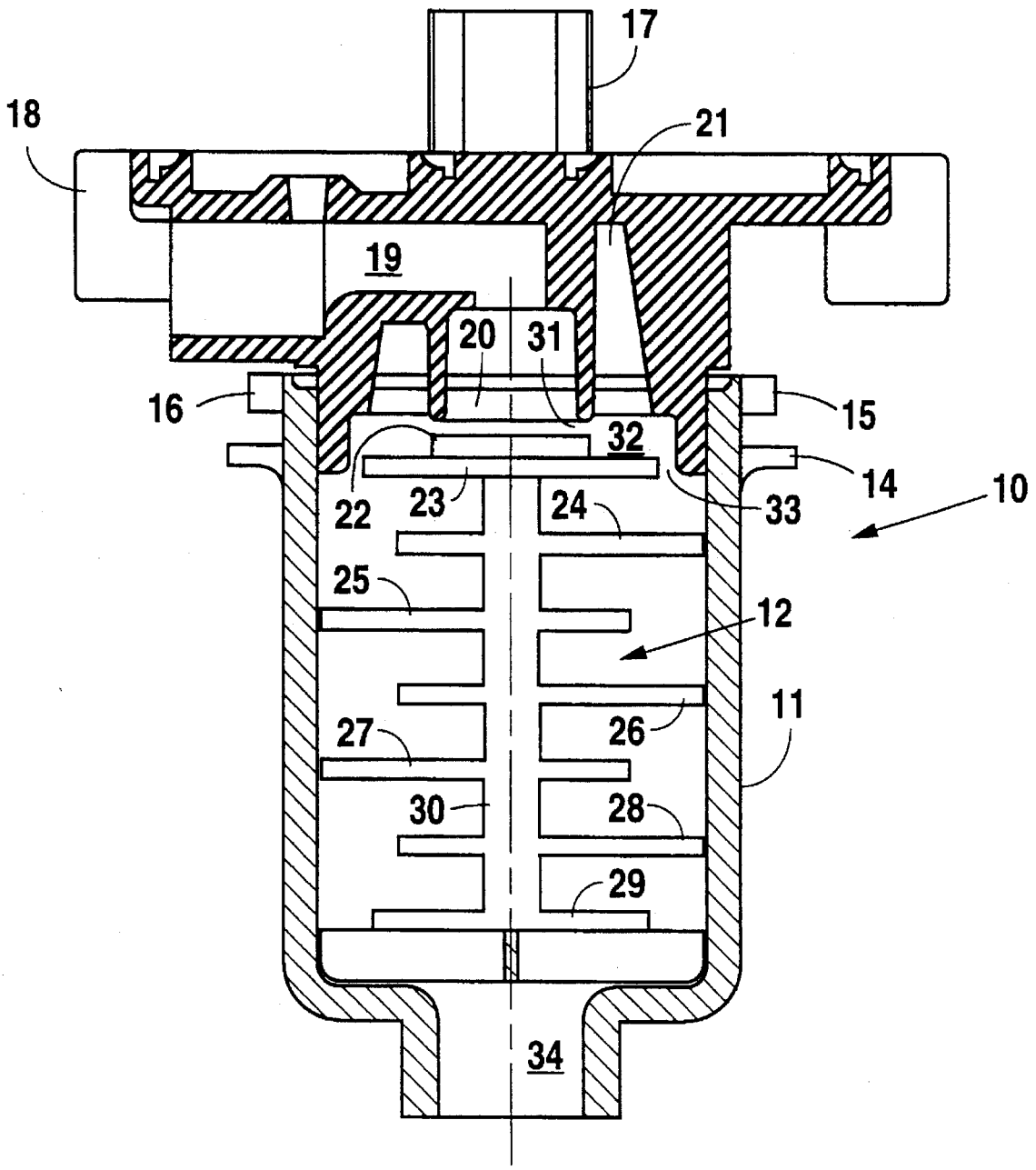
FIG. 1 is a side elevation view in cross-section depicting the postmix beverage dispensing nozzle of the present invention connected to the lower unit of a dispensing valve.
Figure 2:
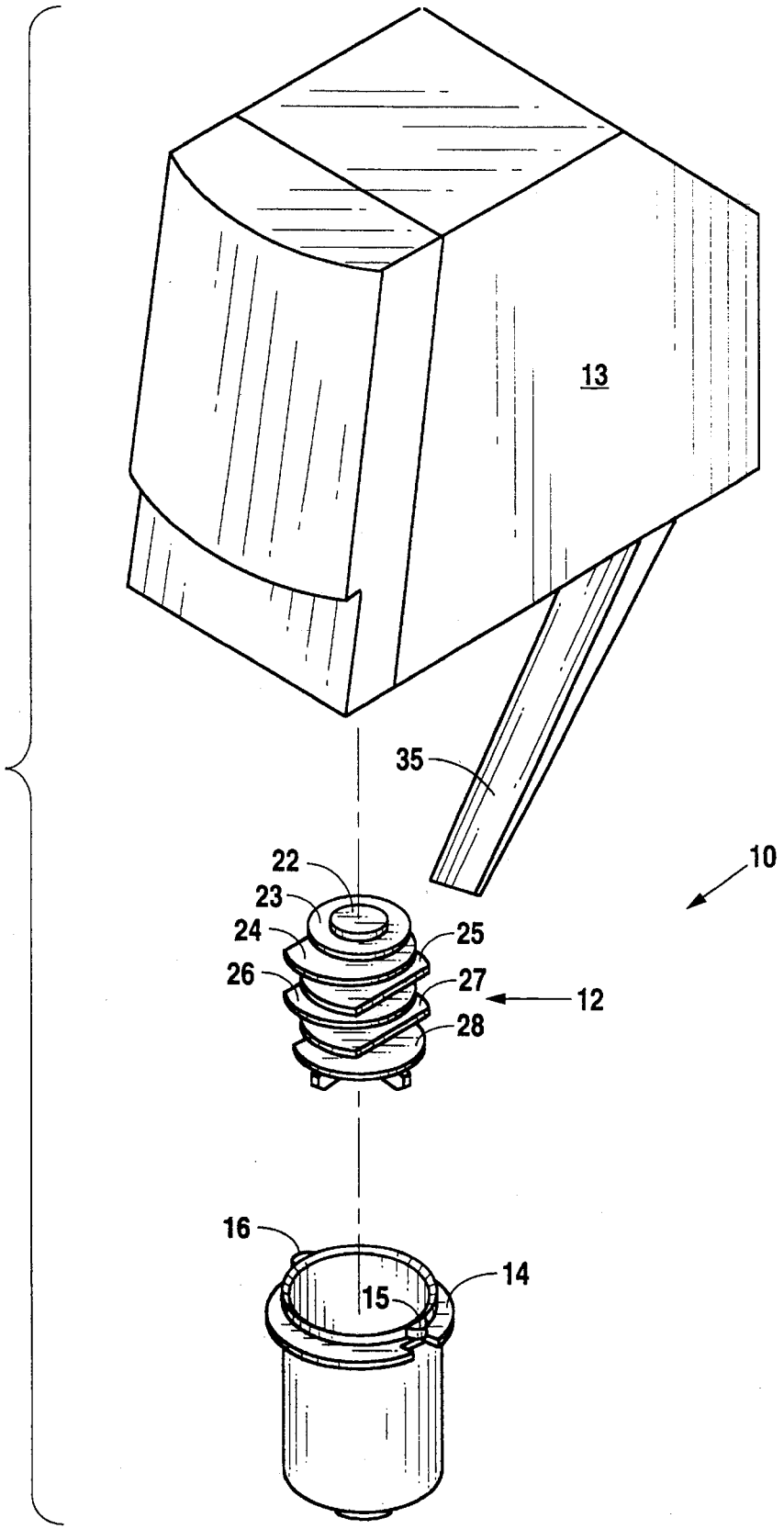
FIG. 2 is an exploded perspective view depicting the connection of the postmix beverage dispensing nozzle of the present invention to a dispensing valve.

As illustrated in FIGS. 1 and 2, postmix beverage dispensing nozzle 10 comprises housing 11 and diffuser 12. Diffuser 12 resides within housing 11, while housing 11 connects to dispensing valve 13. Dispensing valve 13 may be either an electric or manual valve that is suitable to deliver a mixing fluid and a beverage syrup to nozzle 10. Housing 11 includes lip 14 and tabs 15 and 16 that permit the connection of housing 11 to dispensing valve 13. The underside of dispensing valve 13 includes an opening (not shown) which permits lower unit 17 of dispensing valve 13 to protrude. The edges of the opening include a pair of slots (not shown) adapted to receive tabs 15 and 16.

Thus, to connect housing 11 to dispensing valve 13, tabs 15 and 16 are inserted through their corresponding slot, and then housing 11 is rotated such that tabs 15 and 16 catch the inner surface of the edge along the opening in the underside of dispensing valve 13. Additionally, lip 14 abuts the outer surface of the edge along the opening in the underside of dispensing valve 13. With housing 11 connected to the underside of dispensing valve 13, lower unit 17 resides within the inlet into housing 11 to communicate both beverage syrup and mixing fluid into nozzle 10.

Lower unit 17 of dispensing valve 13 connects at inlet 18 to a beverage syrup source (not shown) using a suitable syrup conduit. The syrup is pumped through inlet 18 into passageway 19. The syrup travels from passageway 19 into nozzle 10 via outlet 20. Lower unit 17 further includes a second inlet (not shown) which connects to a mixing fluid source, typically a public water line, using a suitable conduit. The inlet communicates with cavity 21 formed within lower unit 17 to fill cavity 21 with the mixing fluid. A pump suitable for pumping the mixing fluid resides between the mixing fluid source and the inlet into cavity 21 to pump the mixing fluid into cavity 21. Cavity 21 circularly surrounds outlet 20 from passageway 19 to swirl the mixing fluid about outlet 20 and direct it radially downward on top of diffuser 12 via outlet 32.

Diffuser 12 comprises plates 22–29 interconnected by post 30. Plate 22 is circular in shape so that, when outlet 20 of passageway 19 delivers the beverage syrup onto it, the beverage syrup forms a thin sheet directed radially outward from the center of plate 22 to expose the maximum surface area of the beverage syrup to the mixing fluid. Thus, as the thin sheet of beverage syrup passes beyond the outer edges of outlet 20 and plate 22 through space 31, the mixing fluid exiting outlet 32 from cavity 21 shears the thin sheet of beverage syrup. The mixing fluid shears the thin sheet of beverage syrup due to its radially downward direction created by its swirling about cavity 21 before exiting cavity 21 via outlet 32.

The mixing fluid not only shears the beverage syrup exiting space 31, but it also drives the beverage syrup onto plate 23. Plate 23 again radially deflects the mixing fluid and beverage syrup outward to form a second thin sheet. That thin sheet mixes with the mixing fluid swirling about the outer edges of cavity 21 to provide an extremely vigorous first mix of mixing fluid and beverage syrup.

As the mixing fluid and beverage syrup swirl within outlet 32 of cavity 21, a portion of the mixed mixing fluid and beverage syrup exits outlet 32 via space 33 between the outer edge of plate 23 and the inner edge of outlet 32. A portion of the escaping mixed mixing fluid and beverage syrup drops directly onto plate 24, while another portion drops towards plate 25. The mixed mixing fluid and beverage syrup striking plate 24 flows back off plate 24 and directly into the mixed stream of mixing fluid and beverage syrup flowing towards plate 25 to cut that stream and force it against the inside wall of housing 11. The mixed mixing fluid and beverage syrup then cascades down plates 26–29 and exits housing 11 into a cup via outlet 34. Plates 24–29 are truncated circles to provide a cascading effect that vigorously mixes the mixing fluid and beverage syrup. The cascading motion of the mixing fluid and beverage syrup traveling from plate to plate is somewhat similar to the mixing effect achieved when fluid is continuously passed between two cups. Plate 29 includes a truncated portion to allow the resultant beverage comprised of the mixed mixing fluid and beverage syrup to pass from housing 11 out outlet 34.

In operation, when lever 35 is pressed, it activates switches that, in turn, activate the beverage syrup and mixing fluid pumps. Consequently, those pumps deliver beverage syrup into passageway 19 and mixing fluid into cavity 21, respectively. The beverage syrup exits passageway 19 onto plate 22 where it spreads into a thin sheet directed radially outward from the center of plate 22. The mixing fluid enters cavity 21 that circularly swirls the mixing fluid and directs a portion of the mixing fluid radially downward along its inner surface. The mixing fluid directed radially downward contacts the thin sheet of beverage syrup exiting outlet 20 of passageway 19 via space 31 and drives that beverage syrup into plate 23. The mixing fluid swirling within cavity 21 contacts the sheared beverage syrup and delivers it from outlet 32 of cavity 21 via space 33. The mixed mixing fluid and beverage syrup drops onto plate 24 which directs it towards the mixed mixing fluid and beverage syrup dropping towards plate 25. Those two streams of mixed mixing fluid and beverage syrup collide and drop onto plate 25 where the resultant mixed stream cascades down plates 26–29 to exit housing 11 at outlet 34 to form a dispensed beverage that is completely mixed and has a proper ratio of mixing fluid to beverage syrup.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

We claim:

1. A post mix beverage dispensing nozzle, comprising:

a housing removably connectable to a dispensing valve; and a diffuser disposed in said housing, said diffuser comprising a first plate residing directly beneath a beverage syrup outlet of said dispensing valve to force a beverage syrup delivered from the beverage syrup outlet into a thin sheet and direct the thin sheet radially outward and a second plate residing directly beneath a mixing fluid outlet of said dispensing valve that surrounds the beverage syrup outlet wherein a mixing fluid delivered from the mixing fluid outlet shears the thin sheet of beverage syrup as it spreads past said first plate and drives it against said second plate to mix the mixing fluid and beverage syrup.

2. The post mix dispensing nozzle according to claim 1 wherein said diffuser further comprises a plurality of interconnected plates connected to said first and second plates.

3. The post mix dispensing nozzle according to claim 2 wherein, after the mixing of the beverage syrup and mixing fluid, the resulting mixed stream of mixing fluid and beverage syrup cascades down the plurality of plates to receive a vigorous mixing before exiting said housing of said nozzle.

4. The post mix beverage dispensing nozzle according to claim 2 wherein said first and second plates are circularly shaped and said plurality of interconnected plates are truncated circles.

* * * * *